US007263847B2

(12) United States Patent
Faude

(10) Patent No.: US 7,263,847 B2
(45) Date of Patent: Sep. 4, 2007

(54) ELECTRIC REFRIGERATOR

(76) Inventor: Rudolf Faude, Biberacher Str. 39, DE-72336 Balingen (DE)

( * ) Notice: Subject to any disclaimer, the term of this patent is extended or adjusted under 35 U.S.C. 154(b) by 437 days.

(21) Appl. No.: 10/512,921

(22) PCT Filed: Apr. 16, 2003

(86) PCT No.: PCT/EP03/03957

§ 371 (c)(1),
(2), (4) Date: Oct. 29, 2004

(87) PCT Pub. No.: WO03/093743

PCT Pub. Date: Nov. 13, 2003

(65) Prior Publication Data

US 2006/0086106 A1 Apr. 27, 2006

(30) Foreign Application Priority Data

Apr. 30, 2002 (DE) ..... 102 19 486

(51) Int. Cl.
*F25B 49/00* (2006.01)
*F25D 11/00* (2006.01)

(52) U.S. Cl. ..... 62/132; 62/440; 236/1 C

(58) Field of Classification Search ..... 62/125, 62/126, 129, 132, 440; 236/1 C, 51
See application file for complete search history.

(56) References Cited

U.S. PATENT DOCUMENTS

| | | | | |
|---|---|---|---|---|
| 4,148,194 A | | 4/1979 | Kells | |
| 4,404,813 A | | 9/1983 | Paddock et al. | |
| 4,407,141 A | * | 10/1983 | Paddock | 62/130 |
| 4,926,654 A | | 5/1990 | Johnson | |
| 5,419,148 A | | 5/1995 | Kuehl et al. | |
| 5,868,195 A | * | 2/1999 | Westbrooks, Jr. | 165/267 |
| 6,786,058 B2 | * | 9/2004 | Sanna | 62/229 |

FOREIGN PATENT DOCUMENTS

| | | |
|---|---|---|
| DE | 1 451 125 | 5/1969 |
| DE | 74 35 912 | 5/1975 |
| DE | 35 03 552 A1 | 8/1986 |
| DE | 94 20 648.1 | 6/1995 |
| DE | 690 24 395 T2 | 5/1996 |
| DE | 197 53 669 A1 | 6/1998 |
| DE | 298 22 887 U1 | 6/2000 |
| EP | 0 687 875 A1 | 12/1995 |
| JP | 09113127 | 5/1997 |

* cited by examiner

*Primary Examiner*—Marc Norman
(74) *Attorney, Agent, or Firm*—Pauley Petersen & Erickson

(57) ABSTRACT

An electric refrigerator comprising a cooling space in which a temperature sensor is arranged and which is closable by a heat-insulating door. The temperature sensor is connected to a device which regulates the cooling temperature and is adjustable by a temperature-setting device. The temperature sensor and the regulating device are disposed separately from the temperature-setting device inside or preferably outside the cooling space.

5 Claims, 1 Drawing Sheet

ELECTRIC REFRIGERATOR

BACKGROUND OF THE INVENTION

1. Field of the Invention

This invention relates to an electrical cooling device, such as a refrigerator, having a cooling chamber which can be closed by a heat-insulating door and wherein a heat sensor is arranged for regulating the cooling temperature and is connected by a regulating device with a temperature-preselection arrangement.

2. Discussion of Related Art

A refrigerator is taught by German Patent Reference DE 35 03 552 A1, having a back with an evaporator arranged and connected with a compressor. A capillary tube sensor is attached to the rear cooling chamber wall as the temperature sensor.

It is known to use an electronic regulator connected with an electrical temperature sensor. The temperature sensor is arranged at an optimal measuring point at the inner rear wall of the cooling chamber and is connected by an electrical cable with the electronic regulator. The electronic regulator is contained at an inner lateral wall in a regulator housing, which at the same time has a manually operable setting wheel for setting the desired cooling temperature. A setting wheel is taught by German Patent Reference DE 94 20 648 U1, for example.

The temperature sensor, as well as the electronic regulating arrangement, must be placed into special housings which are waterproof and at the same time strain-resistant. For retaining a satisfactory regulating quality during its operation, the electronic regulating arrangement is cast in a watertight medium and dipped in a protective lacquer.

Such treatment of the electronic components is elaborate and thus cost-intensive. Furthermore, if the component housing becomes leaky, such an arrangement is also prone to malfunction.

SUMMARY OF THE INVENTION

One object of this invention is to provide a cooling device which assures dependable temperature regulation, along with a simple and cost-effective construction. The cooling device in accordance with this invention is intended to be distinguished by a simple and convenient operation.

This object of this invention is achieved by an electrical cooling device as described in the specification and the claims of this invention.

The temperature sensor and the regulating device are arranged separately from the temperature-preselection arrangement. Here, the temperature sensor and the regulating device are preferably arranged inside the cooling chamber, and the temperature-preselection arrangement outside of the cooling chamber. Thus the cooling temperature can be conveniently set from outside of the cooling device. The door to the cooling chamber need not be opened for resetting or checking the set cooling temperature.

Thus it is particularly advantageous to provide the temperature sensor and the regulating device in a common housing. Mounting inside the cooling chamber is thus made easier and at the same time components are saved. For providing a moisture-and waterproof housing of the electronic components in the cooling chamber, the housing can be cast in a waterproof material and/or provided with a protective lacquer.

For production it is advantageous to integrate the temperature sensor and the regulating device into a common printed circuit board. Housing the temperature sensor and the regulating device in an integrated circuit results in a relatively small size. Such an arrangement can be easily inserted in a common housing and sealed.

In connection with one simply constructed embodiment, the temperature-preselection arrangement can have a potentiometer with a setting wheel which can be manually actuated and on which the desired cooling temperature can be easily set.

One embodiment of this invention will be explained in greater detail in view of the drawings.

BRIEF DESCRIPTION OF THE DRAWING

The FIGURE shows a cooling device in a lateral and basic sectional view.

DESCRIPTION OF PREFERRED EMBODIMENTS

Figure 1:
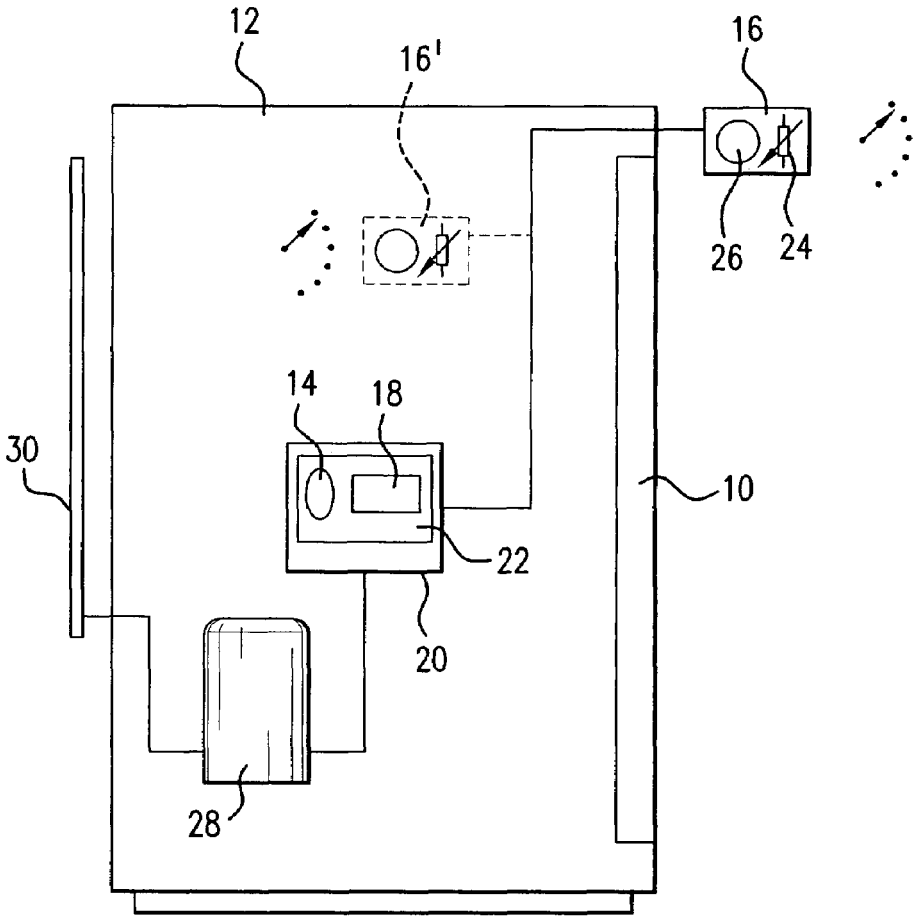

The cooling device has an inner cooling chamber 12 which is closed at one side by a cooling chamber door 10. The cooling device shown is a household refrigerator.

A flat evaporator 30 is arranged at the rear of the cooling device and is connected with a compressor 28 via a system of tubes. The compressor 28 is connected via an electrical conduit to a housing 20 arranged inside the cooling chamber 12.

The housing 20 contains an electrical printed circuit board 20, on which an electrical temperature sensor 14 and the temperature-regulating circuit 18 are housed. The arrangement comprising the temperature sensor 14 and the temperature-regulating circuit 18 can also be arranged in an integrated circuit. Such an IC chip can be produced in a cost-efficient manner, particularly in large numbers, and is of a particularly small size, so that the housing surrounding it can also be designed small.

The housing 20 is waterproof and is cast in a strain-resistant material at the same time. Synthetic resin or a similar plastic material are used for this purpose.

The temperature-regulating circuit 18 is connected by an electrical supply line with a temperature-preselection arrangement 16 arranged outside of the cooling chamber at the front with the door 10. The temperature-preselection arrangement 16 has a potentiometer 24, which can be manually adjusted by a setting wheel 26. The potentiometer 24 is wired together with the temperature-regulating circuit 18 so that a preselected temperature can be set by a graduated dial.

In another embodiment, the temperature-preselection arrangement 16' can also be arranged inside the cooling chamber.

A multiple-contact switch can also be provided in place of the potentiometer 24, which allows preselection of the temperature in predefined temperature steps. A graduated scale, which represents the set temperature, can also be provided on the multiple-contact switch.

This invention claimed is:

1. An electrical cooling device, having a cooling chamber (12), which can be closed by a heat-insulating door (10), and wherein a temperature sensor (14) for regulating the cooling temperature is arranged and is connected by a regulating device (18) with a temperature-preselection arrangement (16), wherein the temperature sensor (14) and the regulating device (18) are arranged inside the cooling chamber (12) and are enclosed in a common housing (20), and the temperature-preselection arrangement (16) is arranged outside the cooling chamber (12), the electrical cooling device comprising:

the temperature sensor (14) and the regulating device (18) housed on a common electrical printed circuit board (22), and the temperature-preselection arrangement (16) connected by an electrical conduit with the regulating device (18).

2. The electrical cooling device in accordance with claim 1, wherein the housing (20) is at least one of cast in a waterproof material and provided with a protective lacquer.

3. The electrical cooling device in accordance with claim 2, wherein the temperature sensor (14) and the regulating device (18) are housed in one of an integrated circuit and a control circuit with an integrated temperature sensor.

4. The electrical cooling device in accordance with claim 3, wherein the temperature-preselection arrangement (16) has one of a potentiometer (24) and a multiple-contact switch with a setting wheel (26) that is manually operable.

5. The electrical cooling device in accordance with claim 1, wherein the temperature-preselection arrangement (16) has one of a potentiometer (24) and a multiple-contact switch with a setting wheel (26) that is manually operable.

* * * * *